United States Patent [19]

Arden

[11] 3,952,964

[45] Apr. 27, 1976

[54] PACKAGES FOR PILE FABRICS

[75] Inventor: Frederic R. Arden, Salem, N.H.

[73] Assignee: Malden Mills, Inc., Lawrence, Mass.

[22] Filed: Nov. 15, 1974

[21] Appl. No.: 524,135

[52] U.S. Cl. ..... 242/77.1; 206/389; 242/62

[51] Int. Cl.[2] ..... B65D 85/67; B65H 75/02

[58] Field of Search ..... 242/62, 77.1; 206/49, 206/389, 408; 211/45

[56] References Cited

UNITED STATES PATENTS

| | | | |
|---|---|---|---|
| 2,895,604 | 7/1959 | Schwartz | 242/77.1 X |
| 2,944,751 | 7/1960 | Schwartz | 242/77.1 X |
| 3,189,172 | 6/1965 | Williams | 242/77.1 X |

*Primary Examiner*—Stanley N. Gilreath
*Assistant Examiner*—John M. Jillions
*Attorney, Agent, or Firm*—Gottlieb, Rackman, Reisman & Kirsch

[57] ABSTRACT

There are disclosed packages for pile fabrics which safeguard against the layers in a fabric roll bearing against each other and against the entire roll from "telescoping". The fabric is wound on conventional hook strips. Cupped eyelets are formed in the strips, a pair of eyelets straddling every fabric layer. After the roll of fabric is wound, a skewer is passed through the fabric layers and the eyelets along each strip. Even if a fabric edge is torn off from a hook, as often happens during rough handling of a package, the layer is prevented from bearing against an adjacent layer because its edge is limited to movement between the two straddling eyelets along the skewer; and if the fabric edge is torn off from many or all hooks on one side, the roll is prevented from telescoping toward the opposite side when the package is stood on its end.

44 Claims, 14 Drawing Figures

PACKAGES FOR PILE FABRICS

This invention relates to packages for pile fabrics, and more particularly to packages which ensure that layers of rolled fabrics do not bear against each other and that the rolls do not telescope, even when the packages are subjected to rough handling.

Fragile pile fabrics are often shipped in the form of rectangular or square-shaped "rolls". It is well known that if the convolutions or layers or a roll bear against each other, the pile may be distorted. For this reason a pile fabric package is usually designed to ensure that the layers of the fabric are held apart from each other.

In the most widely used type of package, each square-shaped end wall is provided with four metallic strips, each of which is placed between the center of the end wall and a corner. Along each strip there is a series of hooks for gripping the selvage of the fabric. The end walls are turned together upon an appropriate fixture, and each edge of the fabric is attached to successive hooks on a respective end wall. The fabric is thus wound into a square-shaped roll with the layers being held apart by reason of the two edges of the fabric being secured to the hooks.

The problem with such a package is that the fabric may tear in the vicinity of a hook, especially when the package is subjected to rough handling during shipment. When this happens, a layer which is torn off from a hook may bear against one of the two adjacent layers with the result that part of the roll is damaged. And if the fabric is torn off from many hooks, when the package is stood on its end there results an accordian-like effect in the fabric — a condition known as telescoping.

As will be described in detail below, there have been attempts to provide packages in which the possibility of fabric distortion is minimized. However, the packages which have been proposed have not been completely effective in solving the problem, or they have been difficult to use (that is, it has been difficult to actually prepare a fabric roll within the packages).

It is an object of my invention to provide packages for pile fabrics which are highly effective in preventing the crushing of fabrics, and which at the same time allow rolls of fabric to be properly formed therein at little additional effort and expense.

Briefly, and in accordance with the principles of my invention, each end wall of the package includes a plurality of hook strips of the type now widely used in the industry. However, in the first illustrative embodiment of the invention, along each hook strip cupped eyelets alternate with the hooks. The eyelets are disposed further inwardly from the end walls than the hooks. The fabric is wound on the hooks in the conventional manner. Thereafter, an elongated pin or skewer is inserted through the successive layers of fabric and eyelets along each hook strip, there being one skewer for each of the four hook strips on each end wall. The insertion of the skewers in the eyelets is facilitated by the cupping and alignment of the eyelets so that the time required for inserting the skewers is insignificant compared to the overall time required to roll the fabric within the package.

Once the skewers are in place, the eyelets prevent the fabric layers from bearing against each other while the skewers prevent telescoping, even if the fabric tears away from the hooks. Because the successive layers of the fabric along each hook strip are all pierced by a skewer and there is an eyelet between adjacent fabric layers, one layer is prevented from moving too far toward another by an eyelet, even if the layer does fall off its respective hook. And even if many or all of the layers fall off the hooks, the skewers prevent telescoping of the fabric. While it is still possible for a hook to tear the fabric if the package is subjected to rough handling, it is much less likely that the fabric will tear off from a skewer. This is because when a skewer pierces the fabric it makes a relatively well-rounded hole in it. This is to be contrasted with the tear which is actually made by each hook when the fabric is placed on it, since the hook is fabricated with sharp square edges. Also, the skewer pierces the fabric further in from the selvage, there thus being greater fabric strength in the vicinity which is prone to tearing. The skewer/eyelet combination acts as a second line of defense against fabric tearing. It has been found that even during the roughest handling, the fabric will not be torn off from a skewer as it is often torn off from a hook.

In other embodiments of the invention, rather than to have the hooks and eyelets alternate along each hook strip, each projection from the strip includes both a hook and an eyelet.

Further objects, features and advantages of the invention will become apparent upon consideration of the following detailed description in conjunction with the drawing in which.

Figure 10:
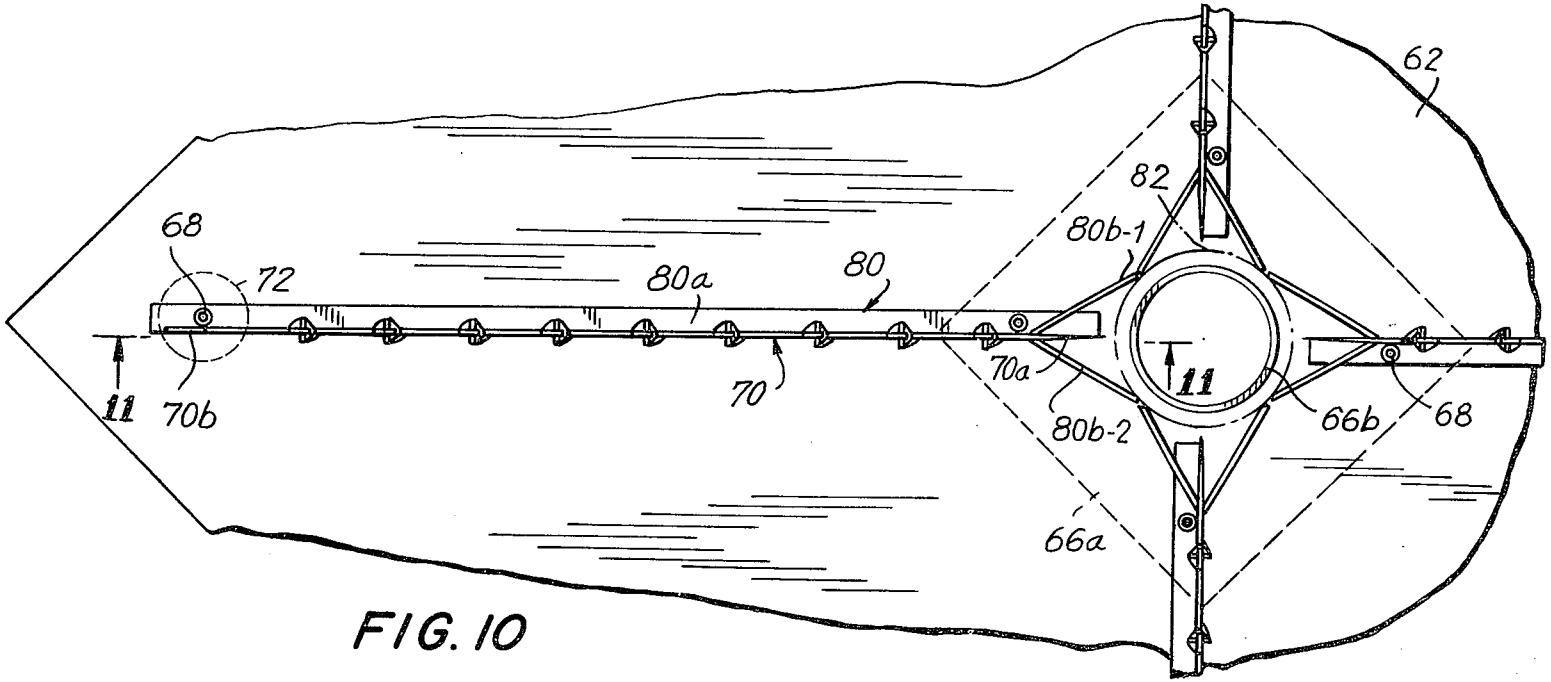
Figure 9:
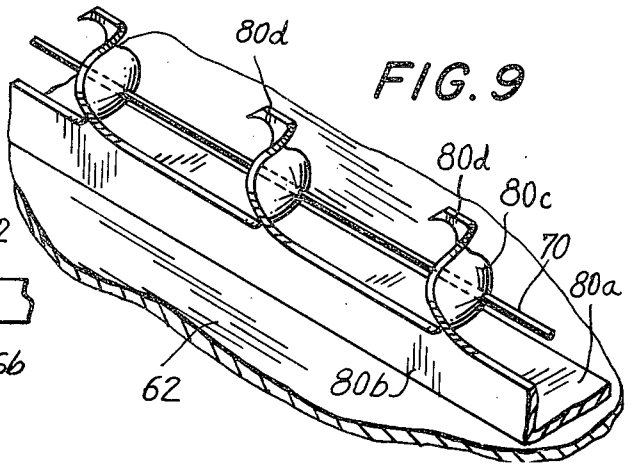
Figure 11:
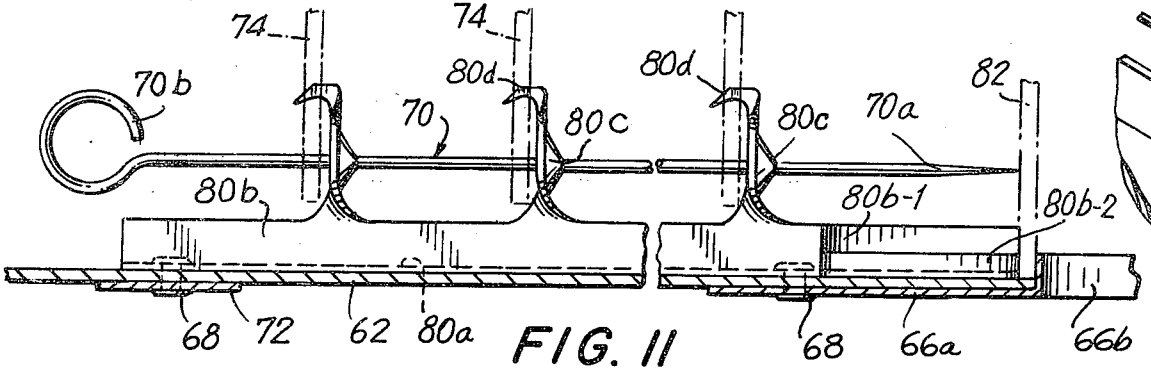
Figure 13:
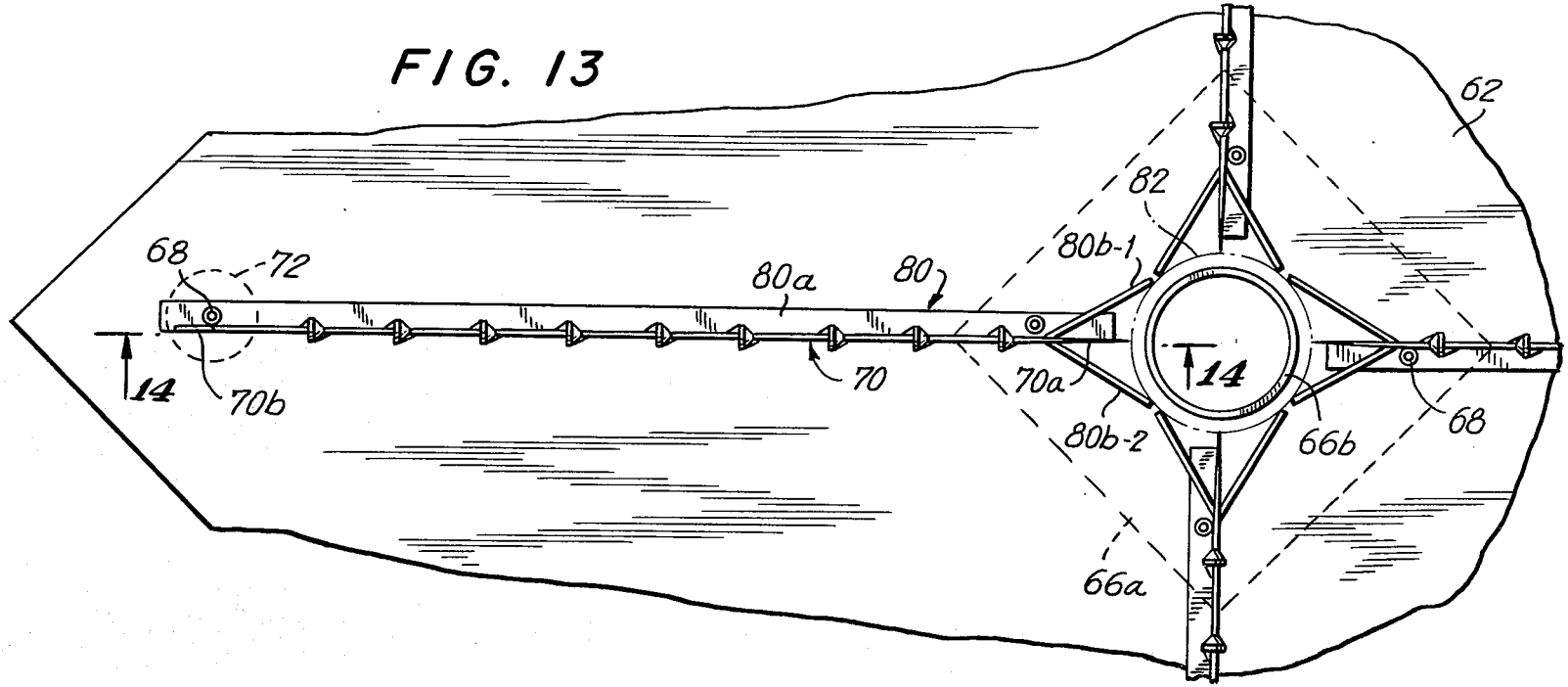
Figure 12:
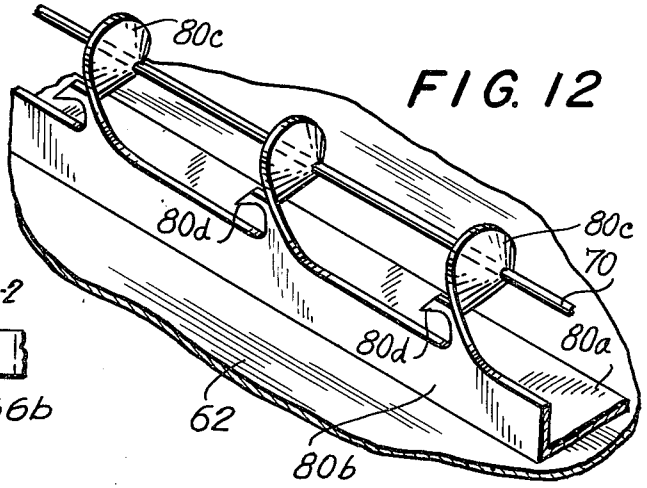
Figure 14:
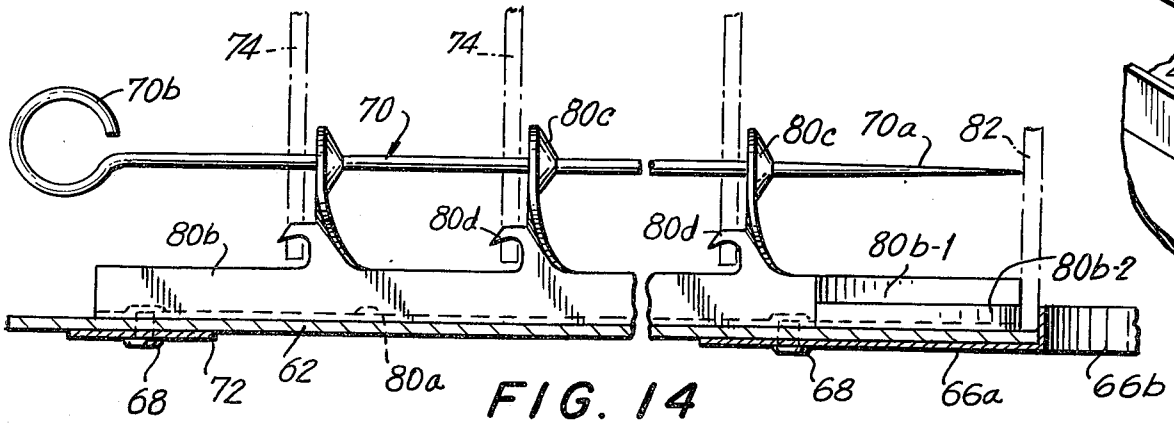

FIGS. 9–11 depict the second illustrative embodiment of my invention, with FIG. 9 being a partial perspective view of a hook strip, FIG. 10 being a partial elevational view of an end wall having four strips mounted thereon, and FIG. 11 being a sectional view taken through the line 11—11 of FIG. 10 and FIGS. 12-14 depict the third illustrative embodiment of my invention, with FIG. 12 being a partial perspective view of a hook strip, FIG. 13 being a partial elevational view of an end wall having four strips mounted thereon, and FIG. 14 being a sectional view taken through the line 14—14 of FIG. 13.

Figure 1:
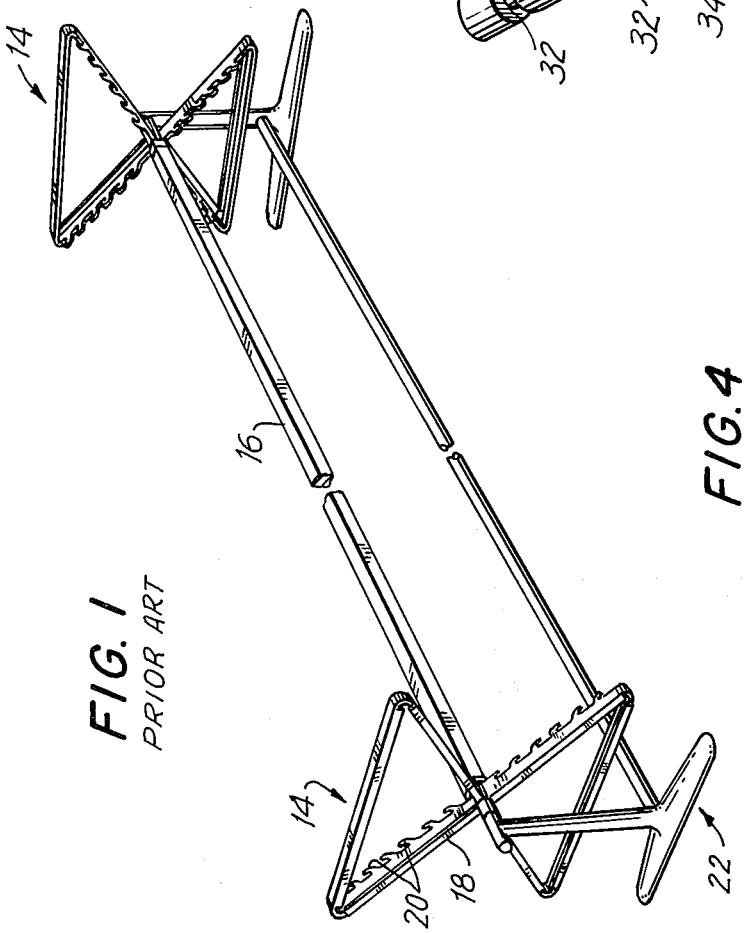
FIG. 1 PRIOR ART
FIG. 1 depicts a first type of prior art pile fabric package reel.

In FIG. 1 there is shown a first type of prior art pile fabric package reel. The carton which is wrapped around the reel is not shown; instead, the reel is shown mounted for rotation on a fixture 22 as it is when the fabric is initially wound on the reel. The reel itself consists of two end assemblies 14, separated by a spreader bar 16.

Each end assembly 14 includes four radial arms or hook strips 18, the hooks themselves being shown by the numeral 20. As fabric is pulled toward the reel, the reel is rotated on the fixture. Starting with the hooks at the center of each end assembly, the selvage of the fabric is placed on successive hooks as the reel is turned. This is usually accomplished by having one operator stationed at each end assembly, as is well known in the art. The resulting roll of fabric is square-shaped, with successive layers being held separated apart by the hooks. A carton may then be placed around the reel for shipping purposes. This type of package was one of the first used in the industry, and an example of it is described in considerable detail in Williams U.S. Pat. No. 3,347,484 which issued on Oct. 17, 1967 and is entitled "Reel for Pile Fabrics With Wood Spreader Bar".

The basic problems with the type of package illustrated in FIG. 1 (quite apart from its relatively high cost) is that the fabric very often tears off from the hooks, particularly as the package is moved on and off a truck. It is apparent that if the fabric is torn off from even a single hook, a layer of fabric along each of two sides of the package may bear against one of the two adjacent layers, depending upon the orientation of the package, thereby distorting a considerable amount of fabric. The problem of telescoping is also present should the fabric be torn off many hooks.

Figure 2:
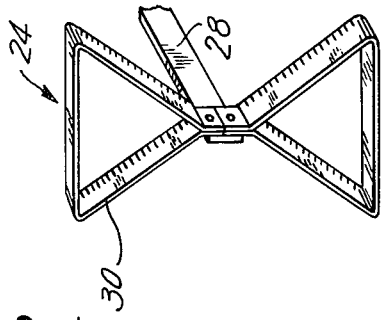
FIG. 2 PRIOR ART
FIGS. 2 and 3 depict parts of a second type of prior art pile fabric package reel, which while effective in preventing the distortion of fabric is difficult to use.
Figure 3:
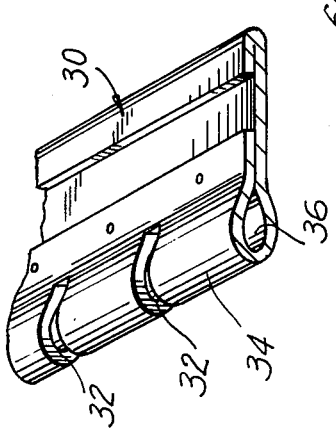
FIG. 3 PRIOR ART

In Schwartz U.S. Pat. No. 2,944,751, which issued on July 12, 1960 and is entitled "Packing Device for Pile Fabrics", there is disclosed a different type of reel. The reel includes two end assemblies and a spreader bar, but the reel is unusual in that the radial arms are not provided with hooks. A single end assembly 24 of the Schwartz type, together with a spreader bar 28, is depicted in FIG. 2. FIG. 3 shows in much greater detail the shape of one of the radial arms 30. It will be noted that the innermost edge of the arm is curled over as shown by the numeral 34 so that a passage 36 is formed. Also, slots 32 are formed along the arm.

The edge of the fabric is placed in successive slots 32 as the overall reel is rotated on a fixture. A wire (not shown) is then forced through passage 36 so that it pierces the fabric edge contained in each of slots 32. In the Schwartz patent a mechanism is disclosed for advancing the wire in passage 36 (in each of the eight radial arms) as a fabric edge is placed in each of slots 32.

The resulting package is effective in reducing the distortion of fabric because there is much less likelihood of the fabric being torn off from the wire which passes "cleanly" through it than there is of fabric being torn off from a hook. The risk of telescoping is also greatly reduced. But the reel depicted in FIGS. 2 and 3 has not enjoyed widespread use in the industry. For one thing, it requires a complex mechanism for advancing the wires as successive convolutions are made. (If a wire is not advanced after a fabric edge is placed in a slot 32, there is nothing to hold the fabric in place.) For another thing, it is more time consuming to manually place a fabric edge in one of the slots 32 as the reel is rotating than it is to hook the fabric as in the case of the reel of FIG. 1.

Figure 4:
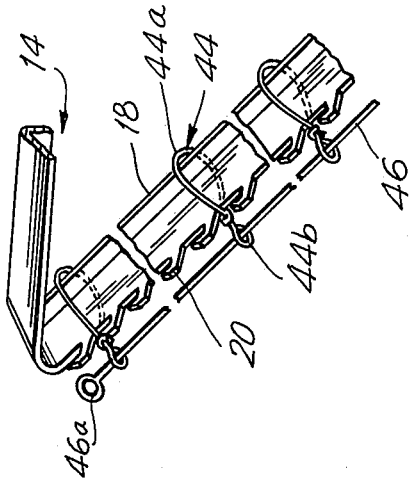
FIG. 4 PRIOR ART
FIG. 4 depicts a third type of prior art pile fabric package reel which has been proposed to solve the fabric-distortion problem, but which is both ineffective and difficult to use.

A relatively recent approach, practiced abroad, to retain the rapid-packaging advantage of hooks, and yet to add the telescope-preventing advantage of wires, is depicted in FIG. 4. In this case, a reel similar to that of FIG. 1 is used, only a part of one of end assemblies 14 being shown in FIG. 4. But, in addition to the basic reel, two or three wire clips 44 are placed around each of the eight hook strips 18. Each clip has a first part, depicted by the numeral **44*a*, which is wrapped around a hook strip. The second part 44*b* of each clip is a ring which is positioned inwardly of the hooks 20 within the package. After the fabric is wound on the reel, a skewer 46 is passed through all of the fabric layers along each hook strip 18, the skewer passing through the two or three rings 44*b* which are disposed along the strip. (The skewer includes a pointed tip, not shown, and a gripping end 46*a*** which is shown in the drawing.)

The skewers serve a function similar to that of the wires used in the end assembly depicted in FIGS. 2 and 3. Even if the fabric is torn off from a hook, it is apparent that as long as the fabric is not torn off from the skewer, the fabric edge is held on the skewer. This prevents the fabric from telescoping toward the opposite end.

The use of such clips has proven to be impractical and dangerous. If as many clips as there are hooks are used, it takes a very great amount of time to pass a skewer through all of the rings along the respective hook strip. Since the clips are not self-aligning, there is nothing to guide the skewer along the strip and the insertion of the pointed end of the skewer in a ring must be done on a hit-and-miss basis. What an operator usually does is to place his fingers between layers of fabric to catch the skewer as it is passed along the hook strip and to place the skewer tip in the next ring. Unfortunately, because the operator cannot see between fabric layers, what often happens is that with one hand the operator is successful in pushing the skewer into his other hand.

Furthermore, this type of reel utilizing two or three clips is ineffective in preventing the distortion of fabric if it falls off from a hook. Since each clip merely serves as a support for the skewer, it does not prevent any two layers of fabric from bearing against each other if they fall off from their respective hooks. To insure that distortion is prevented it would be necessary to provide as many clips as there are hooks. This would require an inordinate amount of time to place the clips on the hook strips and an equally inordinate amount of time to properly position the skewers, not to mention the high costs of materials.

In sum, there is no prior art technique which allows the safe, rapid and economical packaging of fabric in a distortion-and-telescope-proof roll.

Figure 5:
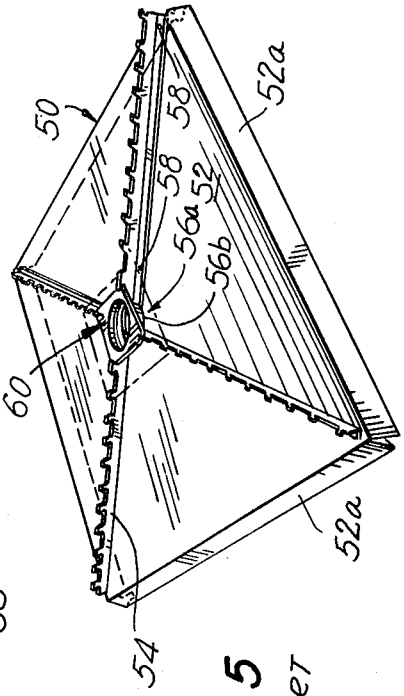
FIG. 5 PRIOR ART
FIG. 5 represents an end wall of the pile fabric package reel which now enjoys widespread usage in the industry (and which does not solve the fabric-distortion or telescoping problem)

The package which is now in widespread use in the industry does not prevent distortion if a hook tear takes place, or telescoping if many hook tears occur. An end wall of this package is represented in FIG. 5 primarily because the construction of the package of my invention can be best appreciated in the context of this prior art package. The package itself consists of two end walls, a separator tube, and an open-ended carton, and is similar to the package shown in U.S. Pat. No. 2,976,987 dated Mar. 28, 1961, issued to Theodore P. Kessler and entitled "Reel for Pile Fabrics".

The end wall 50 of FIG. 5 is made of a square piece of carboard 52, with four outwardly extending flanges **52*a*. A plate 56*a* is placed on the exterior side of the end wall and a sleeve 56*b* extends from the plate through a central hole in end panel 52. Four rigid hook strips 54 are attached to the end panel by rivets 58. (The rivets at the inner ends of the hook strips also serve to secure plate 56*a* in place.) A rotatable plate 60** can be secured in notches provided in the inner ends of the four hook strips. The plate reinforces the end wall, and it is also provided with a hole into which one end of a separator tube may be placed. Sleeve 56*b* fits into the end of the separator tube.

A package is formed by placing a pair of end walls on opposite ends of a rotating fixture with a separator tube being placed between them. The end walls are then turned as the fabric is wound on the radially oriented hook strips. After the fabric is fully wound, an open-ended wrapper is placed around the end walls; the edges of the wrapper bear against the flanges 52*a*, and the flanges are then stapled to the wrapper edges.

The Kessler package is relatively inexpensive and in fact is treated as a disposable item. It is easily assembled and sturdy. It also results in a great deal of distorted fabric because there is absolutely nothing to prevent one layer of fabric from bearing against another if it is torn off from a hook, or the overall roll from telescoping if many layers are torn off.

Figure 7:
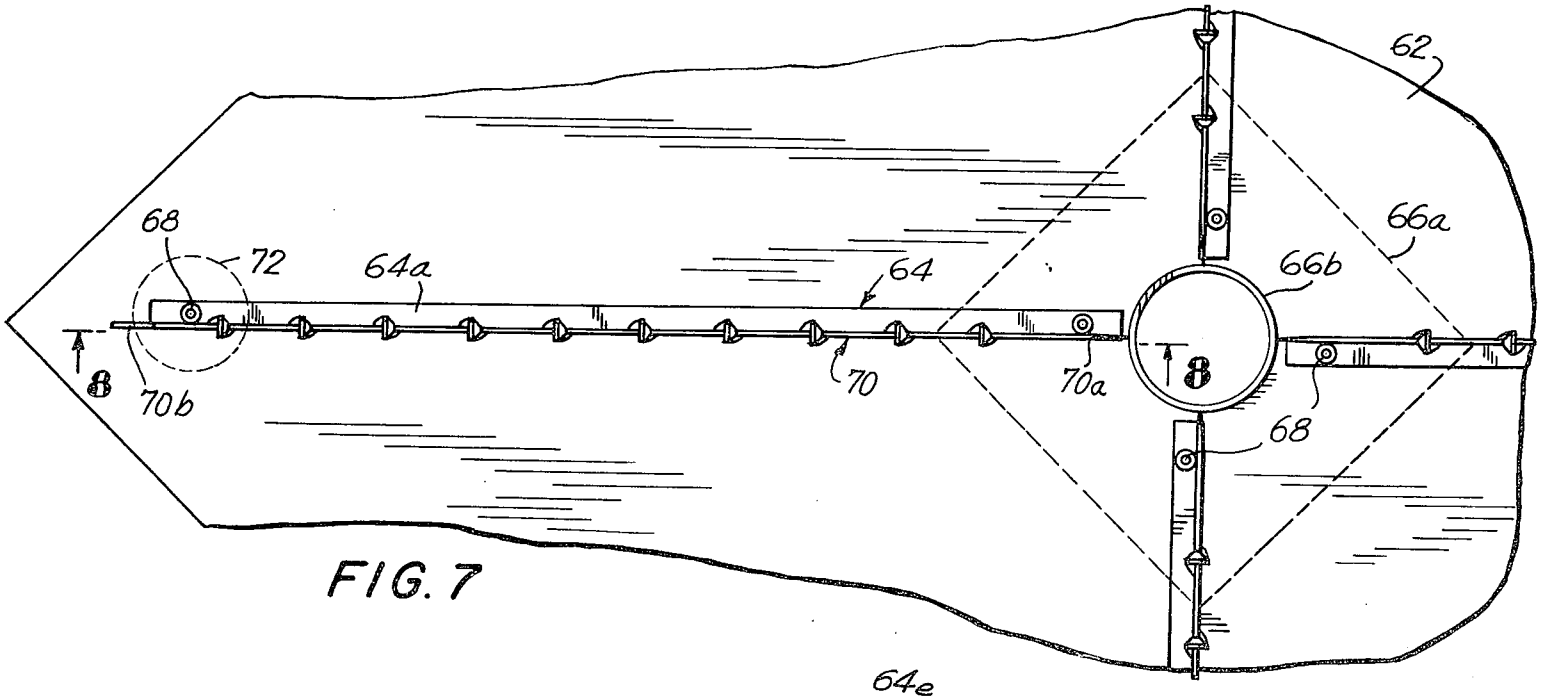
FIGS. 6–8 depict the first illustrative embodiment of my invention, with FIG. 6 being a partial perspective view of a hook strip, FIG. 7 being a partial elevational view of an end wall having four strips mounted thereon, and FIG. 8 being a sectional view taken through the line 8—8 of FIG. 7.
Figure 6:
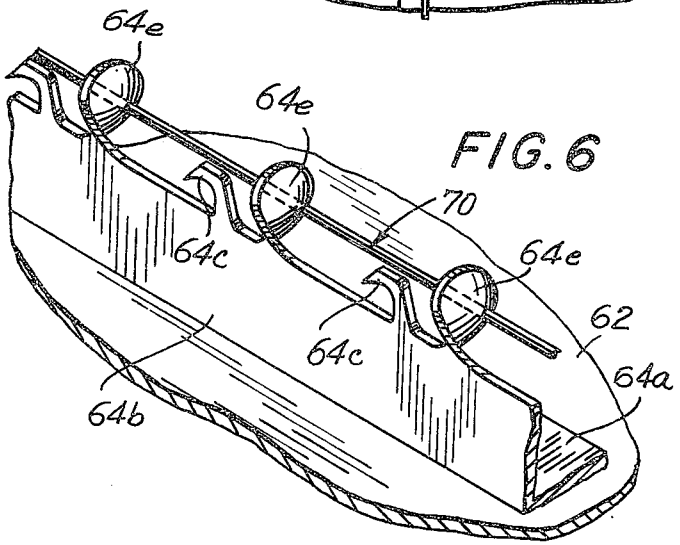
Figure 8:
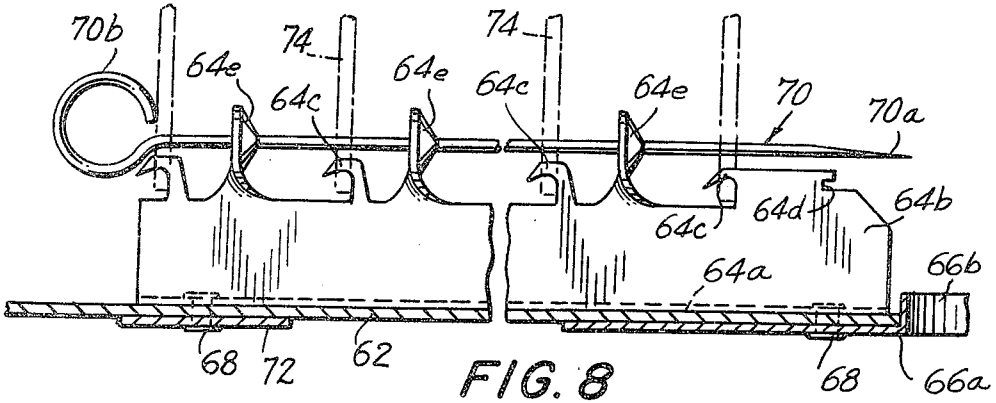

The first illustrative hook strip of my invention is depicted in FIGS. 6–8. Referring to FIGS. 6 and 8, it will be seen that there are cupped eyelets 64*e* which separate the hooks 64*c* along each hook strip 64. After a roll is completed, a steel skewer 70 is passed through the fabric layers. (The fabric layers are shown in phantom by the numeral 74 in FIG. 8; the fabric layers are not shown in FIG. 6.) There is no need to place clips on the radial arms of an end frame as in FIG. 4 because eyelets 64*e* are formed as part of the hook strips themselves. (Although the eyelets are most easily formed with the use of the same stamping equipment which forms the hook strips in the first place, it will be understood that separate eyelet strips can be made, with an eyelet strip being welded or otherwise secured to each hook strip.) Because there is an eyelet between every pair of adjacent fabric layers, as opposed to the prior art reel of FIG. 4 in which there are usually several layers of fabric between successive clips, no matter how many fabric layers are torn off from their respective hooks, the layers do not bear against each other and the fabric is prevented from telescoping — as long as they are not also torn off from the skewers, which is the likely case for the reasons discussed above in connection with the prior art reel of FIGS. 2 and 3. Preferably, the eyelets are cupped in the direction in which the skewer is inserted so that the skewer is actually guided along the cups. The skewer is gripped at end 70*b* and the pointed tip 70*a* is passed through the eyelets starting with the outermost eyelet along the hook strip. Since the eyelets are rigidly aligned, the pointed end will automatically be guided into the eyelet hole (whose diameter, approximately one-eighth of an inch, is just large enough to contain the skewer).

With this brief description of the eyelets and their function, the overall end wall assembly of FIGS. 6–8 will now be described.

The end wall consists of a square-shaped piece of cardboard 62. The end wall may include flanges (not shown), such as flanges 52*a* in FIG. 5, if the overall package is to be assembled by stapling the end wall flanges to an open-ended wrapper. Several (four in the illustrative) embodiment) hook strips 64 are provided, each strip having an L-shaped cross-section to define two legs 64*a*, 64*b*. The hooks and eyelets are stamped out along the top of leg 64*b*, while leg 64*a* is secured to the interior face of end panel 62.

Element 66 consists of a square-shaped support plate 66*a* and a short cylindrical sleeve 66*b*. The sleeve extends through a hole in the center of end panel 62. One end of the conventional spacer tube (not shown) is placed over sleeve 66*b*. The spacer tube is held in place between the two end panels (on the sleeves inserted into the two ends of the tube) by friction of the end metal and by the tension in the fabric itself which pulls the two end panels toward each other. A rivet 68 secures the inner end of each strip to plate 66*a*, the rivet extending through the cardboard. Another rivet is placed at the end of each hook strip, a plate 72 being provided for additional support on the exterior face of the end panel. Although not shown in the drawing another rivet may advantageously secure the middle part of each hook strip to end panel 62.

At the inner end of each hook strip, as seen in FIG. 8, there is a notch 64*d*. This notch serves the function of a similar notch in the hook strips disclosed in the above-identified Kessler patent; a rotatable plate such as plate 60 in FIG. 5 can be placed on the inner ends of the hook strips and rotated in the notches until it is secured in place. This plate adds rigidity to the overall structure and is especially useful when heavy fabrics are to be packaged.

It will be appreciated that the details of construction of the end panels are not critical to the present invention. The present invention is primarily concerned with the hook strips, and not the manner in which they are mounted on an end panel. What is important is that the number of eyelets should be approximately the same as the number of hooks so that each fabric layer (except the innermost and the outermost layers for which it is not necessary) is straddled by a pair of eyelets which prevent the layer from bearing against either adjacent layer if it is torn off from a respective hook. Once the skewers are in place, they perform the holding function. Unlike the prior art in which the hooks are required for holding the fabric layers in place, in the package of my invention the hooks are required only during the packaging step for initially positioning the fabric layers. White it is true that as long as the fabric layers are not torn off from the hooks, the hooks still serve to hold them in place, the "back-up" skewers are the insurance that there will be no distortion or telescoping.

FIGS. 9–11 depict the second illustrative hook strip of the invention, and FIGS. 12–14 depict the third. In these strips, the hooks and eyelets do not alternate. Instead, they are in line with each other. The essential criterion is that a fabric layer be straddled by two eyelets through which a skewer passes and an inspection of FIGS. 11 and 14 reveals that this is indeed the case. If any fabric layer is released from a hook, the edge of the fabric is still pierced by the skewer and is therefore trapped between two eyelets. While the fabric can move between two eyelets, it still cannot bear against an adjacent layer.

Before proceeding with a detailed description of the embodiments of the invention shown in FIGS. 9–11 and 12–14, the relative advantages and disadvantages of the two types of hook strips shown in the drawing should be appreciated. The advantage of the hook strip shown in FIG. 8 is that there is no chance that in passing a skewer through the eyelets along a hook strip, the skewer will miss some of the fabric layers. Since the hooks are closer to the end wall than are the eyelets, if all of the fabric layers are initially held by hooks, the skewer must necessarily pierce every fabric layer as it is inserted in the eyelets. With the hook strip of FIG. 11, on the other hand, the hooks are more inward (in the direction toward the center of the package) than eyelets. It is possible, therefore, that if a hook is placed too near the edge of a fabric layer, that edge may not extend far enough toward the end wall to allow it to be pierced by the skewer which is subsequently inserted through the adjacent eyelet. Thus there may be some fabric layers which are missed by the skewer.

This disadvantage of the hook strip of FIG. 11 is not present in the hook strip of FIG. 14. In the latter embodiment of the invention, it is the eyelets which are more inward (in the direction toward the center of the package) than the hooks. Consequently, as with the hook strip of FIG. 8, the skewer must necessarily pierce every fabric layer as it is inserted in the eyelets.

It will be noted that if a fabric layer is torn off from a hook, that layer can move to the left in FIG. 11 or FIG. 14 to a position very close to an adjacent fabric layer. Although the two layers are still separated by an eyelet, if there is sufficient sag in the fabric the layers may bear against each other especially near the center of the package. This is to be contrasted with the hook strip shown in FIG. 8. If a fabric layer is torn off from a hook in that case, the fabric can move not only to the left, but to the right as well. However, the maximum distance which the fabric can move is approximatley equal to half of the initial distance between the layers as they are held by the hooks. Thus there is less of a chance that two adjacent layers will bear against each other even if the fabric is not properly placed on the hooks during packaging and there is excessive sag.

The advantage of the hook strip 80 of FIG. 11 is that there is more room between each hook 80*d* and leg 80*b* for an operator to work in. The hooks in FIGS. 8 and 14 are very close to the upper edges of respective legs 64*b* and 80*b* and it is more difficult for an operator to place an edge of fabric on a hook when using the strips of FIGS. 8 and 14 than it is when using the strip of FIG. 11. On balance, however, because the more important criterion is that the skewer not miss any fabric layers, the first and third embodiments of the invention are preferred.

Each hook strip 80 in FIGS. 9–11 includes a first leg 80*a* which is mounted on the end panel in a manner comparable to that discussed above with reference to FIGS. 6–8, a second leg 80*b* on which the hooks and eyelets are mounted, and a series of hooks 80*d* and eyelets 80*c*. But the inner edge of each strip in FIGS. 9–11 has two horizontal slits for defining two internal tabs 80*b*-1 and 80*b*-2. These tabs are bent as shown most clearly in FIG. 10. When the four hook strips are mounted to plate 66, the eight tabs serve as stops for containing the separator tube 82 (the tube being shown in phantom in FIGS. 10 and 11). It will be understood that with this arrangement sleeve 66*b* is not required since the tabs serve to center the tube from the outside just as the sleeve serves to center it from the inside. Thus it is to be understood that although sleeve 66*b* is shown in FIGS. 10 and 11 it can be omitted if desired. The second illustrative embodiment of the invention does not include provision for the mounting of a central rotatable plate (plate 60 in FIG. 5), although provision for such a plate may be made if increased strength is desired.

Each hook strip 80 in FIGS. 12–14 is identical to that in FIGS. 9–11, except that the relative positions of hooks 80*d* and eyelets 80*c* are reversed.

Although the invention has been described with reference to particular embodiments, it is to be understood that these embodiments are merely illustrative of the application of the principles of the invention. For example, instead of skewers, strong threads could be used, although in such a case a threading mechanism would have to be provided. And instead of forming integral hook/eyelet strips, separate hook and skewer-guiding strips could be used, positioned, for example, adjacent to each other. Thus it is to be understood that numerous modifications may be made in the illustrative embodiments of the invention and other arrangements may be devised without departing from the spirit and scope of the invention.

What I claim is:

1. A reel for supporting a roll of pile fabric comprising a pair of end panels, separator means for holding said pair of end panels separated from and facing each other, a plurality of radial strips mounted on the inner face of each end panel, each of said radial strips including therealong a plurality of hooks integral with said strip for gripping a fabric edge and a substantially equal number of eyelets integral with said strip, said eyelets being arranged so that all adjacent layers of a rolled fabric secured to the hooks on each radial strip are separated by an eyelet, and means threaded through the eyelets on each radial strip and the fabric layers therebetween for securing said fabric layers in place even if a fabric edge is torn off from a hook.

2. A reel in accordance with claim 1 wherein said eyelets are cupped, aligned and point toward the center of an end panel.

3. A reel in accordance with claim 2 wherein the threaded means through the eyelets on each radial strip is a skewer.

4. A reel in accordance with claim 3 wherein the hooks and eyelets along each radial strip alternate with each other.

5. A reel in accordance with claim 3 wherein eyelets and hooks are formed as combined integral elements projecting from each radial strip.

6. A reel in accordance with claim 5 wherein each integral element projecting from a radial strip includes an eyelet closest to the strip and a hook disposed forward of the eyelet.

7. A reel in accordance with claim 5 wherein each integral element projecting from a radial strip includes a hook closest to the strip and an eyelet disposed forward of the hook.

8. A reel in accordance with claim 1 wherein the threaded means through the eyelets on each radial strip is a skewer.

9. A reel in accordance with claim 8 wherein the hooks and eyelets along each radial strip alternate with each other.

10. A reel in accordance with claim 8 wherein eyelets and hooks are formed as combined integral elements projecting from each radial strip.

11. A reel in accordance with claim 10 wherein each integral element projecting from a radial strip includes an eyelet closest to the strip and a hook disposed forward of the eyelet.

12. A reel in accordance with claim 10 wherein each integral element projecting from a radial strip includes a hook closest to the strip and an eyelet disposed forward of the hook.

13. A reel in accordance with claim 1 wherein the hooks and eyelets along each radial strip alternate with each other.

14. A reel in accordance with claim 1 wherein eyelets and hooks are formed as combined integral elements projecting from each radial strip.

15. A reel in accordance with claim 14 wherein each integral element projecting from a radial strip includes an eyelet closest to the strip and a hook disposed forward of the eyelet.

16. A reel in accordance with claim 14 wherein each integral element projecting from a radial strip includes a hook closest to the strip and an eyelet disposed forward of the hook.

17. A package for supporting a roll of pile fabric comprising a pair of end panels, separator means for holding said pair of end panels separated from and facing each other, a plurality of rigid strip means mounted on the inner face of each end panel, each of said rigid strip means including therealong a plurality of hooks integral with said strip means for gripping a fabric edge and a substantially equal number of eyelets integral with said strip means, said eyelets being arranged so that all adjacent layers of a rolled fabric secured to the hooks on each rigid strip are separated by an eyelet, and means adapted to be threaded through said eyelets for securing said fabric layers in place between adjacent pairs of eyelets even if a fabric edge is torn off from a hook.

18. A reel in accordance with claim 17 wherein said eyelets are cupped, aligned and point toward the center of an end panel.

19. A reel in accordance with claim 18 wherein the hooks and eyelets along each rigid strip means alternate with each other.

20. A reel in accordance with claim 18 wherein eyelets and hooks are formed as combined integral elements projecting from each rigid strip means.

21. A reel in accordance with claim 20 wherein each integral element projecting from a rigid strip means includes an eyelet closest to the strip and a hook disposed forward of the eyelet.

22. A reel in accordance with claim 20 wherein each integral element projecting from a rigid strip means includes a hook closest to the strip and an eyelet disposed forward of the hook.

23. A reel in accordance with claim 17 wherein the hooks and eyelets along each rigid strip means alternate with each other.

24. A reel in accordance with claim 17 wherein eyelets and hooks are formed as combined integral elements projecting from each rigid strip means.

25. A reel in accordance with claim 24 wherein each integral element projecting from a rigid strip means includes an eyelet closest to the strip and a hook disposed forward of the eyelet.

26. A reel in accordance with claim 24 wherein each integral element projecting from a rigid strip means includes a hook closest to the strip and an eyelet disposed forward of the hook.

27. A reel in accordance with claim 17 further including a skewer inserted through the eyelets along each rigid strip means and the fabric layers therebetween.

28. A package for supporting a roll of pile fabric comprising a pair of end panels, separator means for holding said pair of end panels separated from and facing each other, a plurality of radially mounted hooks on the inner face of each end panel for gripping a fabric edge, said hooks being integral with each said panel, a substantially equal plurality of radially mounted eyelets integral with each said panel, said eyelets being arranged so that all adjacent layers of a rolled fabric secured to the hooks are separated by an eyelet, and means adpated to be threaded through said eyelets for securing said fabric layers in place between adjacent pairs of eyelets even if a fabric edge is torn off from a hook.

29. A reel in accordance with claim 28 wherein said eyelets are cupped, aligned and point toward the center of an end panel.

30. A reel in accordance with claim 29 wherein said hooks and eyelets alternate with each other along radii of each end panel.

31. A reel in accordance with claim 29 wherein eyelets and hooks are formed as combined integral elements and are arranged in line with each other along radii of each end panel.

32. A reel in accordance with claim 31 wherein each integral element includes an eyelet closest to the end panel and a hook disposed forward of the eyelet.

33. A reel in accordance with claim 31 wherein each integral element includes a hook closest to the end panel and an eyelet disposed forward of the hook.

34. A reel in accordance with claim 28 wherein said hooks and eyelets alternate with each other along radii of each end panel.

35. A reel in accordance with claim 28 wherein eyelets and hooks are formed as combined integral elements and are arranged in line with each other along radii of each end panel.

36. A reel in accordance with claim 35 wherein each integral element includes an eyelet closest to the end panel and a hook disposed forward of the eyelet.

37. A reel in accordance with claim 35 wherein each integral element includes a hook closest to the end panel and an eyelet disposed forward of the hook.

38. A reel in accordance with claim 28 wherein said hooks and eyelets are arranged along several radii of each end panel and further including a skewer through the eyelets along each such radius and the fabric layers therebetween.

39. A hook strip for use on the end panel of a pile fabric reel comprising means for securing the hook strip along a radius on the inner face of the end panel, a plurality of hooks integral with said strip for gripping a fabric edge extending in a direction which is inward of the end panel when the hook strip is secured thereto, a substantially equal number of eyelets integral with said strip, said eyelets being arranged so that all adjacent layers of a rolled fabric secured to the hooks on the hook strip are separated by an eyelet and means adapted to be threaded through said eyelets for securing said fabric layers in place even if a fabric edge is torn off from a hook.

40. A hook strip in accordance with claim 39 wherein said eyelets are cupped, aligned and point toward the center of the end panel when the hook strip is secured thereto.

41. A hook strip in accordance with claim 40 wherein the hooks and eyelets along the hook strip alternate with each other.

42. A hook strip in accordance with claim 40 wherein eyelets and hooks are formed as combined integral elements projecting from the hook strip.

43. A hook strip in accordance with claim 39 wherein the hooks and eyelets along the hook strip alternate with each other.

44. A hook strip in accordance with claim 39 wherein eyelets and hooks are formed as combined integral elements projecting from the hook strip.

* * * * *